US006082330A

United States Patent [19]

Alberter et al.

[11] Patent Number: 6,082,330

[45] Date of Patent: Jul. 4, 2000

[54] METHOD OF CYLINDER-SELECTIVE CONTROL OF AN INTERNAL COMBUSTION ENGINE

[75] Inventors: Guenter Alberter, Nuremberg; Matthias Becker, Schnaittach; Christof Howold, Sundern; Harald Krohm, Bochum; Ralf Magiera, Neuenrade, all of Germany

[73] Assignees: Temic Telefunken Microelectronic GmbH, Heilbronn; AFT Atlas Fahrzeugtechnik GmbH, Werdohl, both of Germany

[21] Appl. No.: 09/051,638

[22] PCT Filed: Aug. 9, 1997

[86] PCT No.: PCT/EP97/04350

§ 371 Date: Apr. 16, 1998

§ 102(e) Date: Apr. 16, 1998

[87] PCT Pub. No.: WO98/07971

PCT Pub. Date: Feb. 26, 1998

[30] Foreign Application Priority Data

Aug. 16, 1996 [DE] Germany ..... 196 33 066

[51] Int. Cl.[7] ..... F02M 7/00

[52] U.S. Cl. ..... 123/436; 73/117.3

[58] Field of Search ..... 123/436; 73/117.3

[56] References Cited

U.S. PATENT DOCUMENTS

| | | | |
|---|---|---|---|
| 4,161,162 | 7/1979 | Latsch et al. . | |
| 4,705,000 | 11/1987 | Matsumura et al. . | |
| 5,353,764 | 10/1994 | Tomisawa | 123/436 |
| 5,638,278 | 6/1997 | Nishimura et al. | 73/117.3 |
| 5,659,134 | 8/1997 | Tanaka et al. | 73/117.3 |
| 5,698,777 | 12/1997 | Ramseyer et al. | 123/436 |
| 5,778,850 | 7/1998 | Buratti et al. | 123/436 |
| 5,783,744 | 7/1998 | Chun | 123/436 |
| 5,878,366 | 3/1999 | Schricker et al. | 123/436 |

FOREIGN PATENT DOCUMENTS

| | | |
|---|---|---|
| 0113227 | 7/1984 | European Pat. Off. . |
| 0447697 | 9/1991 | European Pat. Off. . |
| 2670831 | 6/1992 | European Pat. Off. . |

OTHER PUBLICATIONS

"Software Funktionbeschreibung [Functional Description of Software], MS 4, B024.V10," dated Feb. 24, 1993, Robert Bosch GmbH, pp. 74–105.

*Primary Examiner*—John Kwon

*Attorney, Agent, or Firm*—Venable; George Spencer; Norman Kunitz

[57] ABSTRACT

A method for the cylinder-selective control of combustion processes in diesel engines. In this case, a measuring device with associated processing unit is used to detect the rotational crankshaft angle and to determine the instantaneous rotational crankshaft speed. A control device determines suitable parameters from the rotational crankshaft speed, which parameters permit a cylinder-selective equalizing or a defined unequalizing of the mean pressures in various operating ranges of the internal combustion engine, thereby minimizing the effects of component differences in the fuel feed system and the combustion system on the combustion process.

19 Claims, 4 Drawing Sheets

ROTATIONAL ANGLE OF THE CRANKSHAFT

FIG. 3a
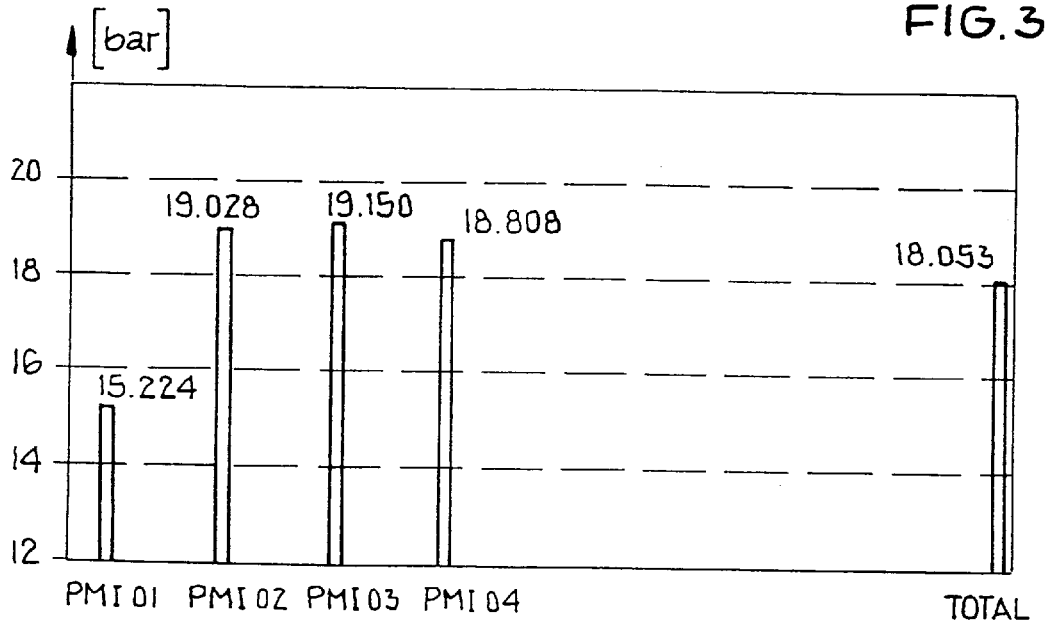
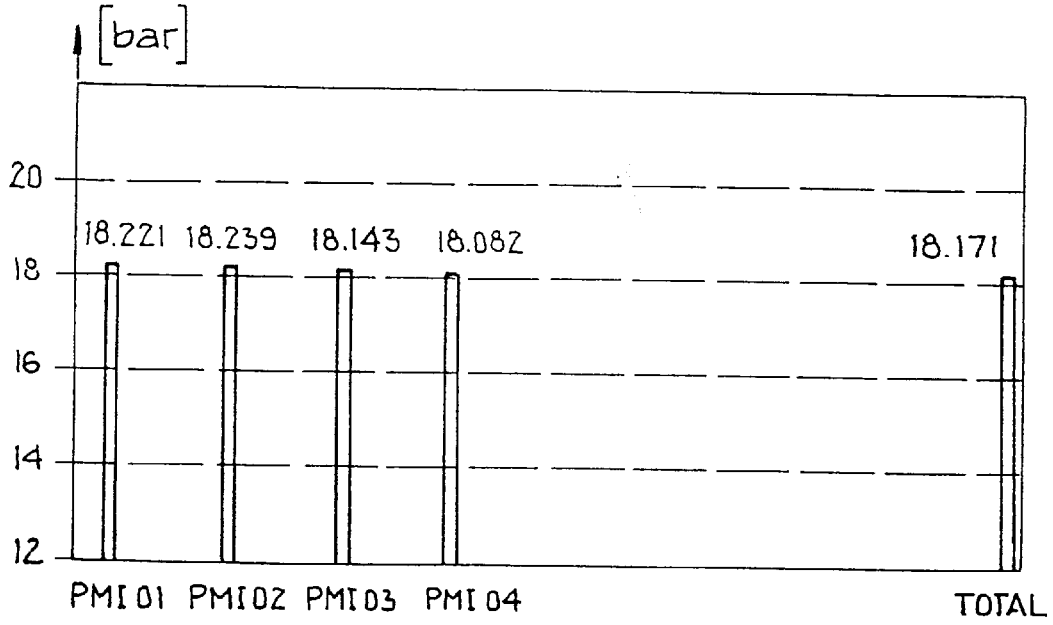
FIG. 3b

FIG.4a
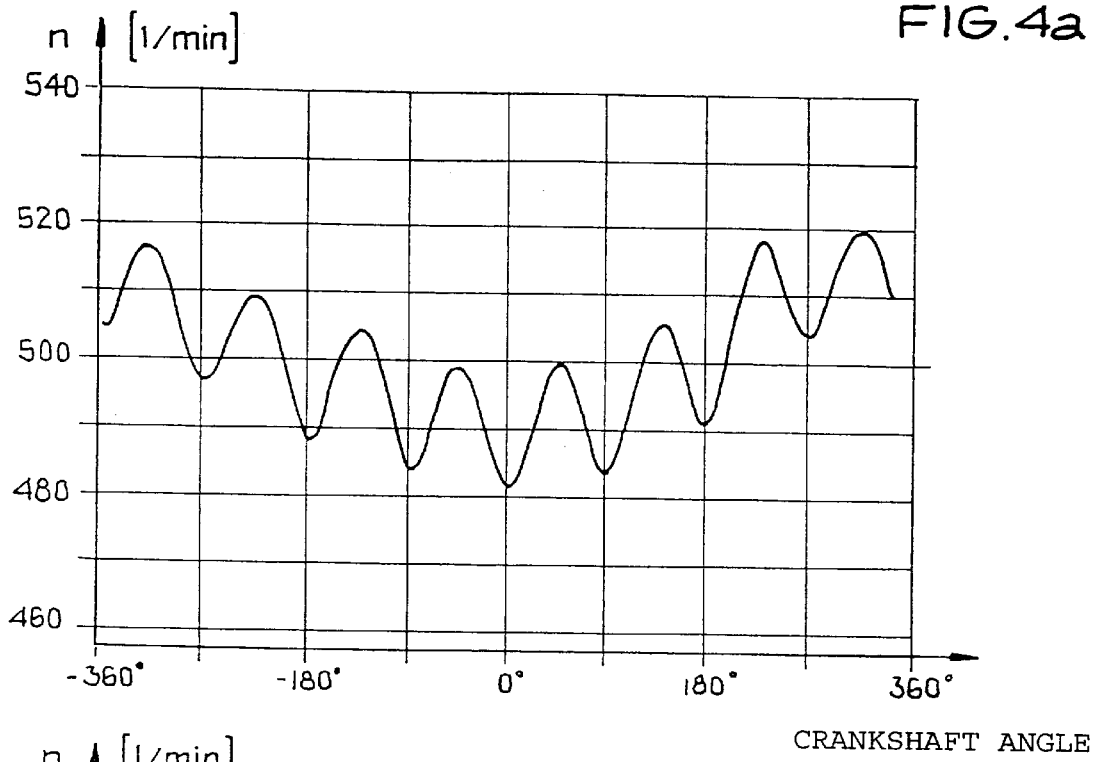
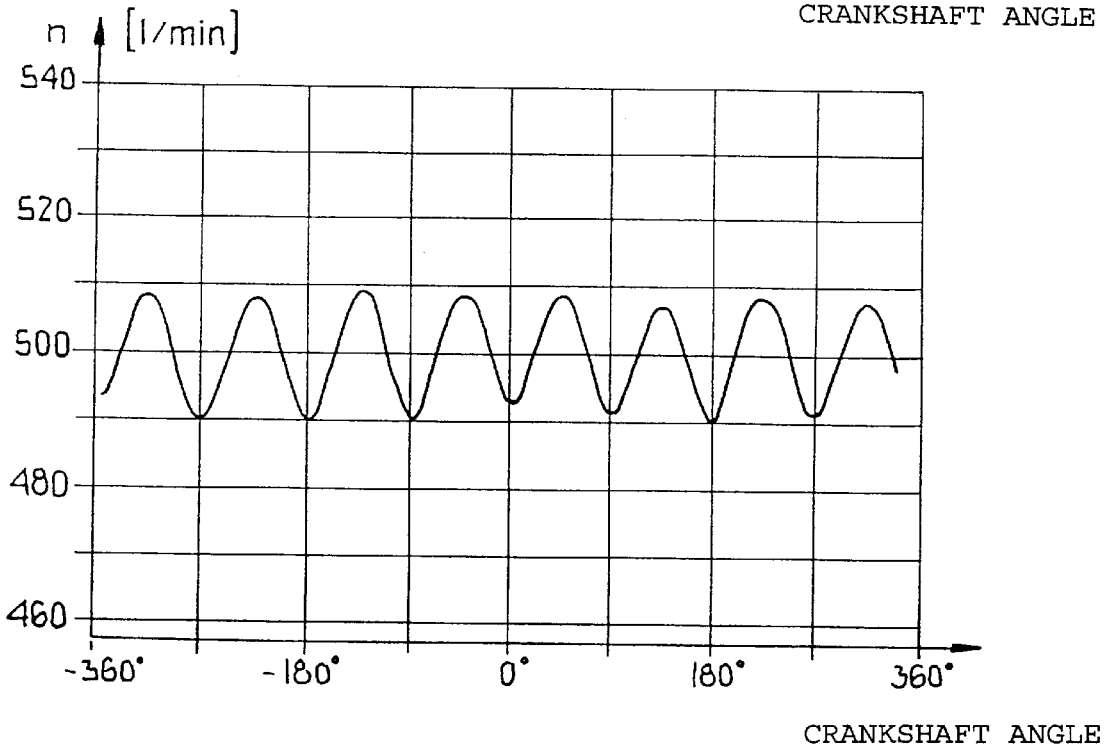
FIG.4b

METHOD OF CYLINDER-SELECTIVE CONTROL OF AN INTERNAL COMBUSTION ENGINE

BACKGROUND OF THE INVENTION

The invention relates to a method for the cylinder-selective control of a multi-cylinder, self-ignition, four-stroke internal combustion engine with cylinder-selective fuel injection, in which method is based on the rotational crankshaft angle and the instantaneous rotational crankshaft speed, as well as a device for carrying out this method.

When compared to an internal combustion engine with spark ignition, e.g. an Otto engine, an internal combustion engine with self-ignition, e.g. a diesel engine, offers fewer options for influencing the combustion method. Thus, the mixture preparation options of an Otto engine are not applicable at all. The operating principle for the diesel engine only permits influencing the start of the injection and the amount of fuel that is injected. Unavoidable differences in the components result in undefined variations in the behavior of the individual cylinders, which can lead to shortcomings with respect to fuel consumption, emission of harmful substances, vibration behavior, synchronizing behavior, acoustics and service life.

All of the component differences here must be understood to be deviations of the diesel engine components from their theoretical ideal value. Said component differences result from unavoidable production tolerances, as well as can be caused during the operation of the internal combustion engine through abrasion, deformation, deposits etc.

The shortcomings caused by the component differences above all concern the differences in those components diesel engine, which play a part in the fuel feed or the combustion operation.

Particularly encumbered with problems are the injection nozzles, for example, which have to meet the requirement that all injection nozzles of a diesel engine must have the exact same hydraulic flow rate for the fuel. This requirement is difficult to realize, owing to the strong dependence of the hydraulic flow rate on the condition of the injection nozzle bore or the fuel temperature or the injection nozzle temperature. A reduction in the hydraulic fuel flow rate for an injection nozzle of a diesel engine during the combustion cycle here leads to a reduction of the mean pressure in the respective cylinder and thus also to irregularities in the crankshaft rotations. The mean pressure is a value that includes the course of the combustion chamber pressure during the combustion cycle of a cylinder, and which can serve as a measure for the energy converted in this cylinder.

The differences in the mean pressure for the individual cylinders lead to different effects in the various operational ranges of the diesel engine. As a result of irregularities in the crankshaft rotation, vehicle parts such as steering wheel, mirror, etc. are stimulated to vibrate during the idling. In the partial load range, this causes an increased emission of pollutants or an increase in the fuel consumption, while in the full load range, the diesel engine does not reach its maximum performance level. The increased stress on the individual cylinders leads to a decrease in the service life of the diesel engine.

It is the object of the invention to specify a method for the control of self-igniting, four-stroke internal combustion engines of the aforementioned type, which method minimizes the effects of differences in the components for the fuel feed and the combustion system to make possible further improvements in the engine characteristics, e.g., the fuel consumption.

This object is achieved in accordance in that the invention with different parameters are derived in dependence on the rotational speed from the course of the curve of the rotational crankshaft speed, which parameters are correlated as closely as possible with the respective mean pressure in the combustion chambers of the internal combustion engine, and from which cylinder-selective correction values for the cylinder-selective equalizing of the mean pressures are determined and used.

In a modification of the invention, correction values can be determined, following the equalizing of the mean pressures, which cause a defined unequalizing of the mean pressures in the combustion chambers of the internal combustion engine. Thus, a cylinder could be fired, for example, to a lesser or greater degree to suppress vibrations or resonances in the motor vehicle.

The equalizing or defined unequalizing of the mean pressures in the combustion chambers of the internal combustion engine is caused by the cylinder-selective change in the injection site and the amount of fuel injected into the combustion chambers of the internal combustion engine.

It is provided here that the cylinder-selective changes in the injection site and the amount of fuel injected into the combustion chambers of the internal combustion engine are made such that the sum of the cylinder-selective changes is equal to zero, thereby ensuring that the operating state desired by the driver or the power output of the internal combustion engine is not changed.

It is preferable if two types of parameters from the course of curve for the instantaneous rotational crankshaft speeds are used to equalize the cylinder-selective mean pressures: the mean rotational speed values formed above a maximum 720 degree rotational angle for the crankshaft, divided by the number of cylinders, or the rotational speed amplitudes.

For this, the rotational speed amplitudes for the course of curve of the instantaneous rotational speed of the crankshaft are determined by averaging several instantaneous rotational speeds for the same rotational angle of the crankshaft for the periodically repeating operating cycle of the internal combustion engine, which operating cycle for the most part includes respectively two crankshaft rotations.

One advantageous modification of the invention consists in the storage of curve courses for the instantaneous rotational speeds of the crankshaft and/or cylinder-selective correction values for comparison purposes. In this case, the values can be stored following the production of the internal combustion engine, following a repair, or following optional intervals.

The stored curve courses for the instantaneous rotational speeds of the crankshaft and/or the cylinder-selective correction values can be used for the early detection of combustion problems and/or compression problems in the internal combustion engine. The result of an early detection can be displayed in the motor vehicle, or can be called up during an inspection in a special repair shop.

A further advantageous modification of the invention consists in that the rotational angle of the crankshaft is detected with a measuring device with signal transmitter on the crankshaft and that the instantaneous rotational speeds of the crankshaft are determined from this with the aid of a processing unit.

In order to clearly associate the periodically repeating operating cycle of the diesel engine, comprising two crankshaft rotations, with the rotational crankshaft angle, the camshaft can be provided with a measuring device with signal transmitter, which permits the detection of the rotational camshaft angle, thereby providing information on whether a cylinder is in the $1^{st}$ or $3^{rd}$, or in the $2^{nd}$ or $4^{th}$ power stroke.

In addition, the measuring devices for the crankshaft and the camshaft can be monitored as to their efficiency. For this, the ratio of the signals emitted by the individual signal transmitters for the two measuring devices must be constant.

One modification provides that a separate signal transmitter for the measuring device on the crankshaft and for the measuring device on the camshaft is used for marking a specified rotational angle for the respective shaft.

In addition, signals from signal transmitters on the crankshaft and the camshaft can be used to check the synchronization between crankshaft and camshaft.

Alternatively, the rotational angle for the crankshaft and the rotational speed of the crankshaft can also be determined from the rotational angle of the camshaft.

The cylinder-selective equalizing or the defined unequalizing of the mean pressure in this case make it possible to influence the emission of pollutants, the fuel consumption, the vibration behavior, the synchronizing behavior, the service life and/or the acoustics of the internal combustion engine.

The various parameters do not reflect the cylinder-selective mean pressure without distortion, but are changed more or less in the various rotational speed ranges by lateral influences that depend on the rotational speed. It can follow from this that one parameter is correlated with the cylinder-selective mean pressures more in the lower rotational speed range while the other parameter is correlated more in the upper rotational speed range for a diesel engine, which makes it necessary to use the parameters in a way that is specifically tied to the rotational speed. The use of varied parameters for varied rotational speed ranges of the diesel engine permits the equalizing or defined unequalizing of the mean pressure in dependence on the instantaneous rotational crankshaft speed in order to exert different influences. In the range of 300 –700 rotations per minute, for example, a vibration reduction can be carried out on the basis of rotational speed amplitudes, while in the range of 3000–6000 rotations per minute, the combustion engine can be controlled so as to minimize the exhaust gas emissions on the basis of averaged, instantaneous values for the rotational crankshaft speeds.

It is possible to carry out further error diagnoses on the basis of information on cylinder-selective correction values for varied rotational crankshaft speeds. Thus, a low correction value with low rotational crankshaft speeds and a high correction value with high rotational crankshaft speeds for a cylinder lead to the conclusion of a reduced hydraulic flow rate for the respective injection nozzle.

Finally, one advantageous modification provides for a separate, independent fuel feed system as device for carrying out the method for each cylinder of the internal combustion engine, which fuel feed system respectively comprises an injection pump, a line and an injection nozzle, the so-called PLD system. The crankshaft is also provided with a measuring device for detecting the rotational angle of the crankshaft, as well as an associated processing unit for determining the instantaneous rotational speed of the crankshaft. In order to detect the rotational angle of the camshaft, the camshaft is provided with a measuring device for determining the instantaneous rotational speed of the camshaft.

The method according to the invention is described and explained below using the example of a four-cylinder diesel engine and in connection with the drawings.

BRIEF DESCRIPTION OF THE DRAWINGS

FIG. 3*a* is an illustration of the cylinder-specific mean pressures of a four-cylinder diesel engine without activated single-cylinder compensation;

FIG. 3*b* is an illustration of the cylinder-specific mean pressures of a four-cylinder diesel engine with activated single-cylinder compensation.

FIG. 4*a* shows a typical course of a curve for the instantaneous rotational crankshaft speeds above 720 degrees rotational crankshaft angle, without activated idling control for an eight-cylinder diesel engine.

FIG. 4*b* is a typical course of a curve for the instantaneous rotational crankshaft speeds above 720 degrees rotational angle of the crankshaft, with activated idling control for an eight-cylinder diesel engine.

DETAILED DESCRIPTION OF THE PREFERRED EMBODIMENT

Figure 1:
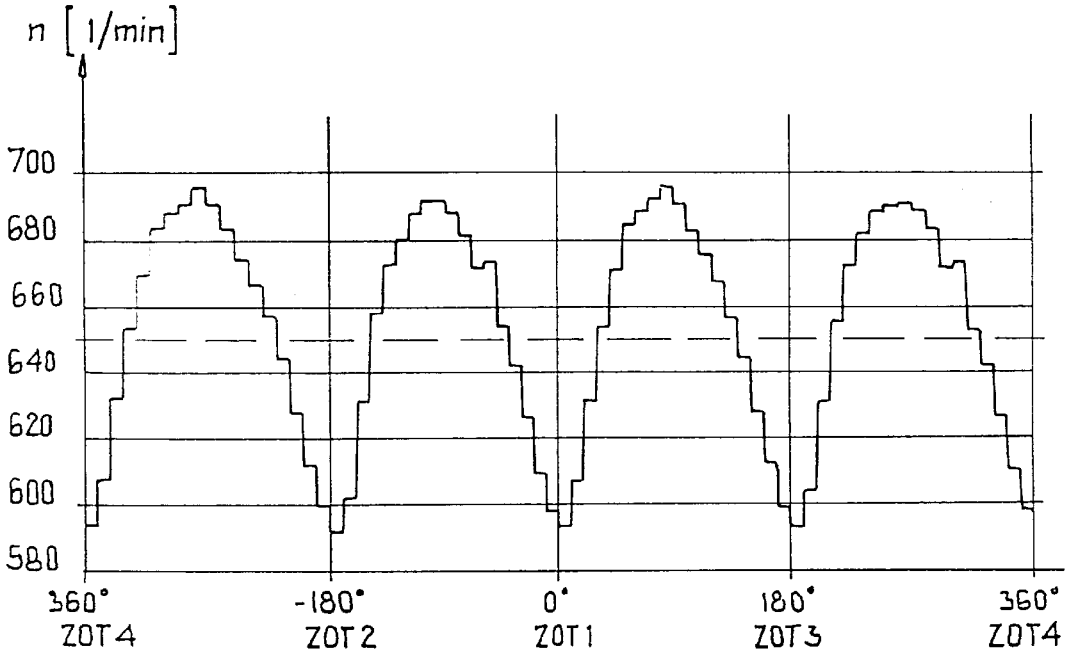
FIG. 1 shows a typical course of a curve for the instantaneous rotational crankshaft speed above 720 degree rotational angle for the crankshaft of a four-cylinder diesel engine.

The equalizing of the cylinder-selective mean pressures for compensating the component differences requires a separate, independent fuel feed system for each cylinder of the diesel engine, which fuel feed system respectively comprises an injection pump, a line, and an injection nozzle, the PLD (pump-line-nozzle) system. The piston-type injection pumps, operated by the camshaft, are connected on the fuel feed side via magnetic valves to the fuel supply tank, and are connected on the engine side to the injection nozzles. If the magnetic valve is closed, the fuel in the pump chamber is injected into the combustion chamber through pressure from a cam onto the piston of the injection pump. If the magnetic valve is open, the fuel in the pump chamber is merely pumped back into the fuel tank, since the resistance of the injection nozzle cannot be overcome.

The beginning and the end of an injection operation, and thus also the injection duration or the amount of fuel injected, can be controlled through a suitable opening and closing of the magnetic valves by means of a control device provided for the engine control. The rotational moment of a cylinder, which results from the gas force of the combustion process and acts upon the crankshaft, is determined through the injection amount. The rotational speed of the crankshaft results from the sum of the rotational moments acting upon the crankshaft.

In order to determine the instantaneous rotational crankshaft speed, the crankshaft is provided with a measuring device and a processing unit, the signal transmitter of which consists of a transmitter wheel that rotates along with the crankshaft and is provided with 36 markings, as well as one additional marking, which are scanned by an inductive sensor. The additional marking characterizes an angle position of the crankshaft that is known to the control device, e.g. the upper dead center for the $1^{st}$ cylinder. From the inductive sensor signals, the processing unit determines 36 instantaneous rotational crankshaft speeds for one crankshaft rotation. Thus, the control device is provided with the information concerning the rotational angle of the crankshaft and the rotational speed of the crankshaft with a resolution of 10 degrees.

The signal transmitter for the camshaft measuring device consists of a transmitter wheel, rotating along with the camshaft, which has 12 markings and one additional marking that are scanned by an inductive sensor. The additional marking characterizes an angle position of the camshaft that is known to the control device. The control device can determine the rotational camshaft angle and the rotational camshaft speed from the signals of this inductive sensor with a resolution of 30 degrees (analogous to the 60 degree rotational angle for the crankshaft).

Owing to the measuring device on the camshaft, the control device can associate an event in the diesel engine operating cycle that repeats itself periodically for every two crankshaft rotations to a change in the instantaneous rotational speed of the crankshaft. For example, the control device can associate an increase in the rotational crankshaft speed to the expansion of the $3^{rd}$ cylinder.

The two independent measuring devices for crankshaft and camshaft can be used by the control device for a permanent, mutual function check. The ratio of the crankshaft sensor signals to the camshaft sensor signals must be 6:1 for the example cited here.

The control device detects a malfunction in one of the inductive sensors through a change in this ratio, whereupon all control operations based on these measuring devices are deactivated until the defect is corrected. Starting with this malfunction, the diesel engine can continue to be operated, for example, with standard values.

The diesel engine has processed one complete operating cycle after two crankshaft rotations, and each cylinder (of the four-stroke engine) has passed through one combustion cycle. The control device here determines a course of curve from the 72 instantaneous rotational crankshaft speeds above 720 degrees rotational crankshaft angle, which course of curve resembles an amount-shaped sine curve. Such a course of curve is represented in FIG. 1. This course of curve reflects the differences in the mean pressure in the combustion chambers of the internal combustion engine.

The object of the control device is to provide a stable control of the fuel injection, designed to compensate differences in the components by equalizing the cylinder-specific mean pressures.

Since the cylinder-specific mean pressures cannot be determined directly, it is necessary to make available a suitable parameter, to be determined cylinder-specific, which can serve as input information for the control device to determine the control values. This parameter must be distinguished in that the differences in the parameters are correlated as closely as possible with the differences in the mean pressure. In addition, the lateral sensitivity of the parameter should be as low as possible, meaning that if there is a change in the amount injected into a cylinder, the parameter for another cylinder should react as little as possible to this change. The diagnostic ability of the control device is impaired even for a weak lateral sensitivity of a parameter. A stable control of the mean pressures is not possible for strong lateral sensitivities. In accordance with one variation of the injection operation, the reaction of the parameter for a cylinder should furthermore be linear to the variation in the mean pressure caused by this, or should at least be equidirectional and monotonous, since the control device otherwise cannot make a clear diagnosis and would not be able to effect a stable control.

In order to detect such a parameter from the course of curve for the instantaneous rotational crankshaft speed, it is possible to use either mean rotational speed values above 720 degree rotational angle of the crankshaft, divided by the number of cylinders, or to use the rotational speed amplitudes.

Owing to the long detection interval, mean rotational speed values are particularly insensitive to the positioning errors of crankshaft markings, which become more influential with high rotational crankshaft speeds. With heightened sensitivity to position errors, rotational speed amplitudes are particularly insensitive to lateral influences.

That is the reason why rotational speed amplitudes are preferably used in the lower rotational speed range and mean rotational speed values are used in the upper rotational speed range as parameter.

Rotational crankshaft speeds of up to 600 rotations per minute can be viewed as the lower rotational speed range for the use of rotational speed amplitudes. In this rotational speed range, the rotational speed amplitudes are used, for example, as parameter for cylinder-selective compression tests of the combustion chambers of internal combustion engines.

For the rotational speed range above 600 rotations per minute, it is preferable if mean rotational speed values are used as parameter for the cylinder-selective determination of correction values.

Figure 2:
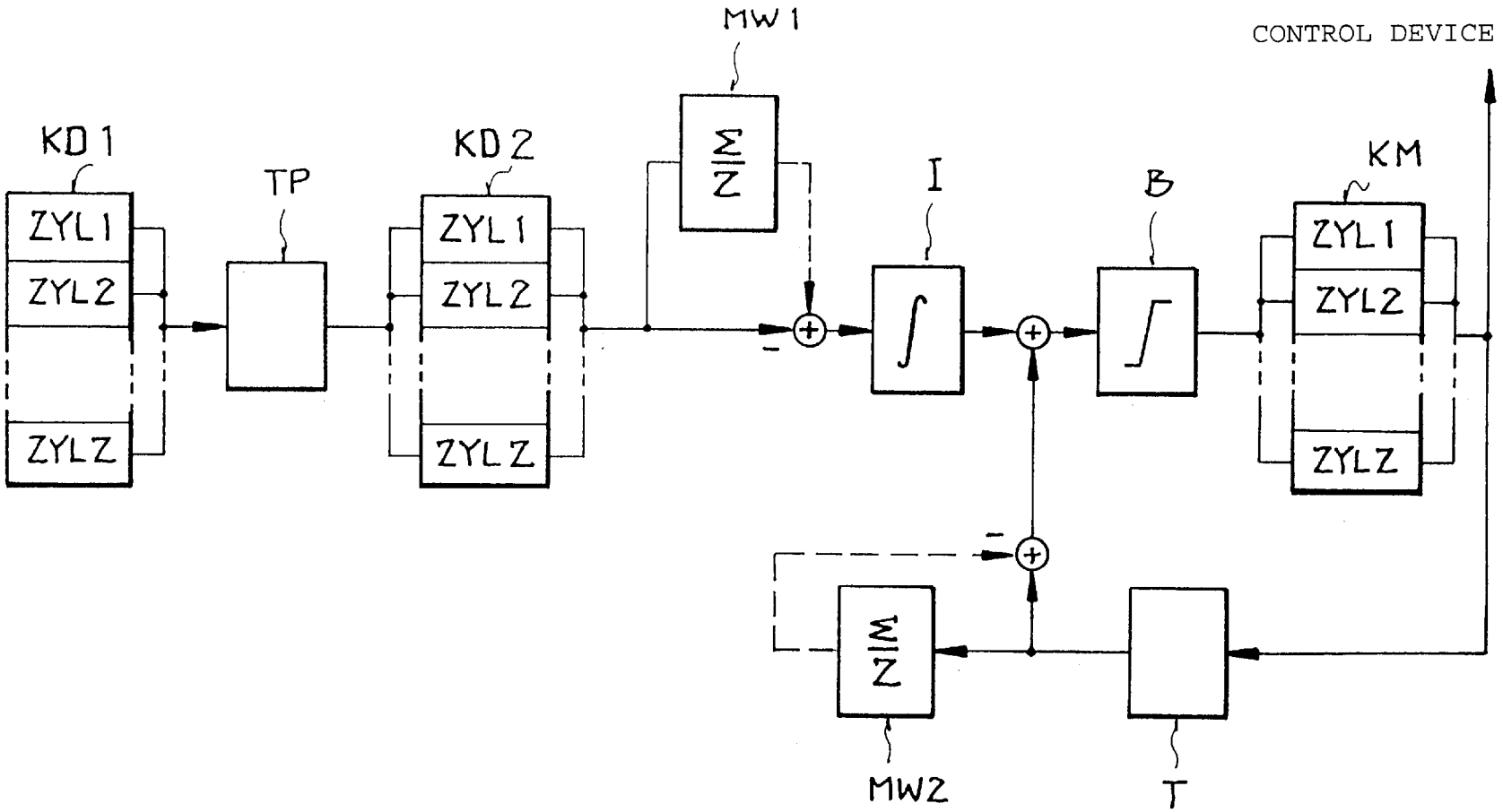
FIG. 2 is an illustration of the control algorithm for equalizing the mean pressures.

The method for the individual cylinder compensation, for which the mean pressures of the cylinders are equalized, is described in the following by referring to the control algorithm in FIG. 2. In this case, mean rotational speed values above 720 degree rotational angle of the crankshaft, divided by the number of cylinders, are used as the parameter, wherein correction moments are determined as correction values.

For the individual cylinder compensation, the instantaneous rotational crankshaft speeds KD1, respectively associated with a cylinder, are guided over a low-pass filter TP with applicable filtering factor to suppress cyclical fluctuations. For a four-cylinder, four-stroke engine, these represent the instantaneous rotational crankshaft speeds for a rotational crankshaft angle of 180 degrees.

The mean value MW1 from respectively two crankshaft rotations is formed from the filtered, instantaneous rotational crankshaft speeds KD2 by adding up the filtered rotational crankshaft speeds, divided by the number Z for the cylinders. This mean value MW1 is respectively added to the negated mean value of the filtered, instantaneous rotational crankshaft speeds for the same two crankshaft rotations, which results in the respective deviation of the filtered, instantaneous rotational crankshaft speeds to their mean value MW1. These deviations from the mean value MW1 are viewed as standard deviation. The compensation of the cylinder-selective standard deviations for equalizing the mean pressures occurs via an integrator amplification I with applicable amplification factor, as a result of which the standard deviations are converted to cylinder-selective correction moments KM.

The integrator amplification I is followed by an integrator control, expanded by one delay element T, which ensures the delay of the control circuit by a rotational crankshaft angle of exactly 720 degrees. A limiting element B is additionally provided in the integrator control and is used to detect whether the correction moment intended for a cylinder is located at a margin used for diagnostic purposes. The cylinder-selective correction moments KM, which are fed via the delay element T to the limiting element B, are further expanded by the negated mean values MW2 of the correction moments KM for a rotational crankshaft angle of 720 degrees, as a result of which the sum of the executed cylinder-selective correction moments KM is equal to zero. This takes place in accordance with the requirement that equalizing the mean pressures will not change the operating state of the internal combustion engine as desired by the motor vehicle driver.

The individual cylinder compensation is considered successfully completed if the deviation for all cylinders is below an applicable limit value prior to the completion of an applicable time interval for an applicable duration. The purpose of the time interval for carrying out a control operation is to stop an unstable control operation.

The cylinder-selective correction moments KM are fed to the control device or are determined and stored in the control device. The control device extracts the suitable control value for the magnetic valves of the fuel supply system from the performance characteristics in order to supply the cylinders with the exact amount of fuel for the operating state desired by the driver, as well as the determined, cylinder-selective correction moments KM.

Several memory locations are provided for storing the cylinder-selective correction moments in the control device. Primarily stored are the cylinder-selective correction moments (basic compensation), which are determined following the production of the diesel engine. In addition, other cylinder-selective correction moments can be stored within the framework of inspections (customer service compensation), following repairs, or following optional time intervals.

The cylinder-selective correction moments, stored following the manufacture of the diesel engine, additionally serve as comparison values, for example, for customer service compensation values determined during an inspection. An early diagnosis of damage to a diesel engine can be made on the basis of such a comparison. It is possible, for example, to identify fuel injection problems or compression problems in the combustion chambers, if a correction moment for a cylinder increases past a limit value.

FIG. 3*a* shows the mean pressures of a four-cylinder diesel engine without activated individual cylinder compensation. In this case, the pressure column PMI 01, associated with the cylinder 1, shows a mean pressure value that is approximately 20% lower as compared to the other cylinders. FIG. 3*b* shows the mean pressures of this four-cylinder diesel engine with activated individual cylinder compensation. All four cylinders have approximately the same mean pressure value in this case.

On the basis of the individual cylinder compensation and by using parameters specifically tied to the rotational speed, the method according to the invention can be used in different ways for various rotational speed ranges of the diesel engine and with the aid of the PLD system, a control device, the measuring devices for crankshaft and camshaft. The individual cylinder compensation method is modified in the following to obtain cylinder-specific correction values for effecting an idling control.

FIG. 4*a* shows the instantaneous rotational crankshaft speeds above 720 degree rotational crankshaft angle for an eight-cylinder diesel engine without idling control, while FIG. 4*b* shows the same with idling control.

Rotational irregularities of the crankshaft strongly encourage the development of vibrations in a vehicle with diesel engine. The vibration sensitivity during the idling of the diesel engine is the result of the short frequency spacing between the inherent frequencies of rearview mirrors, steering wheel, etc. and the diesel engine that rotates with approximately 600 crankshaft rotations per minute while idling.

The idling control is initiated if the rotational crankshaft speed remains constantly below an applicable limit value. The operating sequence for this method is analogous to that for the individual cylinder compensation. It is solely the parameter used and the amplification factor for the integrator amplification that are adapted to the idling control. The control operation for the idling control is completed if the deviations for all cylinders are below an applicable limit value. If this limit value is exceeded, the idling control is activated once more. This results in cylinder-selective correction moments, which correspond to the requirements of an idling control. In this case, the idling control requirements do not have to consist of equalizing the mean pressures, but can also refer to the equalizing of characteristics for the rotational crankshaft speed.

During the partial load/full load operation of the diesel engine, the equalizing of the cylinder-selective mean pressures through compensating component differences with the aid of the individual cylinder compensation results in a minimizing of the fuel consumption, as well as a reduction in the emission of pollutants. An increase in the service life for the diesel engine is achieved through a more even load distribution, the reduction in the tendency to vibrate and the early detection of, for example, defects in the compression and in the injection system or sensor errors. For some operating ranges of the diesel engine, advantages in the operating behavior of the diesel engine can be achieved by purposely varying the stresses on the cylinders, which is possible with this.

The signals from the other inductive sensors on crankshaft and camshaft can be used by the control device for checking the synchronization between crankshaft and camshaft.

We claim:

1. A method for the cylinder-selective control of a multi-cylinder, self-ignition, four-stroke internal combustion engine with cylinder-selective fuel injection and comprising: detecting the rotational crankshaft angle, as well as determining the instantaneous rotational crankshaft speed deriving different parameters in dependence on the rotational speed from the course of a curve of the instantaneous rotational crankshaft speeds; determining cylinder-selective correction values from the derived parameters; and using the correction values to effect a cylinder-selective equalizing of the mean pressure in the combustion chambers of the internal combustion engine.

2. A method according to claim 1, further comprising determining and using further cylinder-selective correction values, if desired, for a defined unequalizing of the mean pressures, following the equalization of the mean pressures in the combustion chambers of the internal combustion engine.

3. A method according to claim 2, wherein the equalizing and the defined unequalizing of the mean pressures in the combustion chambers of the internal combustion engine are achieved by the cylinder-selective change in the amount of fuel injected and the fuel injection site of the combustion chambers of the engine.

4. A method according to claim 2, wherein the cylinder-selective changes in the amount of fuel injected and the site for injecting the fuel into the combustion chambers of the internal combustion engine for, an equalizing or defined unequalizing of the mean pressures are carried out such that the sum of the changes in the mean pressures in the combustion chambers is equal to zero.

5. A method according to claim 2, further comprising forming mean rotational speed values from the course of the curve of the instantaneous rotational crankshaft speeds as a parameter for determining the cylinder-selective correction values.

6. A method according to claim 1, wherein the rotational speed amplitudes are evaluated as parameter for determining the cylinder-selective correction values from the course of curve of the instantaneous rotational crankshaft speeds.

7. A method according to claim 6, including determining the rotational speed amplitudes for the course of the curve of the rotational crankshaft speed by averaging the values for several instantaneous rotational crankshaft speeds for the same rotational crankshaft angle of the periodically repeating operating cycle of the internal combustion engine.

8. A method according to claim 1, wherein at least one of the curve courses of the instantaneous rotational crankshaft speeds and the cylinder-selective correction values are stored for comparison purposes, following the manufacture of the internal combustion engine, following a repair, or following optional intervals.

9. A method according to claim 8, wherein the stored at least one of the curve courses for the instantaneous rotational crankshaft speeds and for the cylinder-selective correction values are used for the early detection of at least one of combustion problems and compression problems in the internal combustion engine and/or for an error diagnosis.

10. A method according to claim 1, wherein the rotational crankshaft angle is detected by a measuring device with a signal transmitter on the crankshaft; and the instantaneous rotational crankshaft speeds are determined from the detected crankshaft angle.

11. A method according to claim 10, wherein the rotational camshaft angle is detected by a measuring device with signal transmitter in order to associate the rotational crankshaft angle with the operating cycle of the internal combustion engine.

12. A method according to claim 11, further comprising monitoring the efficiency of the measuring device on the crankshaft and the measuring device on the camshaft by checking the ratio of the signals emitted by the respective signal transmitters of the measuring devices.

13. A method according to claim 10, wherein respectively one marking of the measuring device for the crankshaft and the measuring device for the camshaft is used to designate a specified rotational angle for the respective shaft.

14. A method according to claim 10, further comprising using the signals from the signal transmitters of the crankshaft and the camshaft to check the synchronization between crankshaft and camshaft.

15. A method according to claim 10, wherein the rotational crankshaft angle and the instantaneous rotational crankshaft speed are derived from the rotational angle of the camshaft.

16. A method according to claim 2, including using the cylinder-selective equalizing or the defined unequalizing of the mean pressure to influence at least one of the emission of pollutants, the fuel consumption, the vibration behavior, the synchronized operation, the service life or the acoustics of the internal combustion engine.

17. A method according to claim 16, wherein the cylinder-selective equalizing or the defined unequalizing of the mean pressure is used in various ways to produce the desired influence, depending on the instantaneous rotational crankshaft speed.

18. A method according to the claim 1, further error diagnosis comprising carrying out further on the basis of the information concerning cylinder-selective correction values for various instantaneous crankshaft speeds of the internal combustion engine.

19. A device for carrying out the method according to claim 1, wherein: for each cylinder of the internal combustion engine, a separate, independent fuel supply system is provided, with each separate fuel supply system comprising one injection pump, one line and one injection nozzle; a measuring device for detecting the rotational crankshaft angle with an associated processing unit for determining the instantaneous rotational crankshaft speed; and, a measuring device for detecting the rotational camshaft angle for assigning the rotational crankshaft angle to the operating cycle of the internal combustion engine.

* * * * *